US010260261B2

(12) United States Patent
Reuter et al.

(10) Patent No.: US 10,260,261 B2
(45) Date of Patent: Apr. 16, 2019

(54) REFRIGERATOR DOOR HINGE

(71) Applicant: Haier US Appliance Solutions, Inc., Wilmington, DE (US)

(72) Inventors: Daryl Lee Reuter, Evansville, IN (US); Brian Culley, Newburgh, IN (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 0 days.

(21) Appl. No.: 15/635,316

(22) Filed: Jun. 28, 2017

(65) Prior Publication Data

US 2019/0003224 A1 Jan. 3, 2019

(51) Int. Cl.

| | |
|---|---|
| ***E05D 7/04*** | (2006.01) |
| ***E05D 3/02*** | (2006.01) |
| ***F25D 23/02*** | (2006.01) |

(52) U.S. Cl.

CPC ..... *E05D 7/0415* (2013.01); *E05D 3/02* (2013.01); *F25D 23/028* (2013.01); *E05D 2007/0469* (2013.01); *E05Y 2900/31* (2013.01)

(58) Field of Classification Search

CPC ..... E05D 3/02; E05D 7/0415; F25D 23/028

USPC ..... 312/401, 405; 16/243, 244, 248, 309, 16/312, 375

See application file for complete search history.

(56) References Cited

U.S. PATENT DOCUMENTS

| | | | | |
|---|---|---|---|---|
| 3,722,031 | A * | 3/1973 | Bourgeois | E05F 1/063 16/317 |
| 4,070,728 | A * | 1/1978 | Herman | E05D 7/0415 16/243 |
| 5,138,743 | A * | 8/1992 | Hoffman | E05F 1/1223 16/303 |
| 5,369,842 | A * | 12/1994 | Beatty | E05F 1/063 16/317 |
| 8,166,612 | B2 | 5/2012 | Bertolini et al. | |
| 8,510,913 | B2 * | 8/2013 | Kim | E05D 11/06 16/268 |
| 9,222,293 | B2 | 12/2015 | Jenkinson | |
| 2006/0168760 | A1 * | 8/2006 | Espindola | E05D 7/02 16/374 |

(Continued)

FOREIGN PATENT DOCUMENTS

| | | | |
|---|---|---|---|
| CN | 205580079 | U | 9/2016 |
| KR | 101206808 | B1 | 11/2012 |

*Primary Examiner* — James O Hansen

(74) *Attorney, Agent, or Firm* — Dority & Manning, P.A.

(57) ABSTRACT

A refrigerator appliance includes a cabinet with a door positioned at the front of the cabinet. The refrigerator appliance also includes a hinge having a hinge bracket coupled to the cabinet. The hinge bracket includes a lateral plate. A pivot pin is received in the lateral plate. The door is rotatably coupled to the pivot plate. A lateral surface of the door is spaced apart from the lateral plate of the hinge bracket along the vertical direction by a height. An adjustable spacer is positioned between the lateral plate of the hinge bracket and the lateral surface of the door to adjust the height. The adjustable spacer includes a rotatable washer and a fixed washer abutting the rotatable washer. The rotatable washer includes a first inclined engagement surface and a second inclined engagement surface. The fixed washer includes a third inclined engagement surface and a fourth inclined engagement surface.

8 Claims, 9 Drawing Sheets

(56) References Cited

U.S. PATENT DOCUMENTS

| | | | | | |
|---|---|---|---|---|---|
| 2009/0038117 | A1* | 2/2009 | Moon | ..... | E05D 7/0027<br>16/240 |
| 2011/0232035 | A1* | 9/2011 | Huang | ..... | G06F 1/1681<br>16/303 |

* cited by examiner

REFRIGERATOR DOOR HINGE

FIELD

The subject matter of the present disclosure relates generally to refrigerator appliances.

BACKGROUND

Refrigerator appliances generally include a cabinet that defines chilled chambers for receipt of food items for storage. One or more insulated, sealing doors are provided for selectively enclosing the chilled food storage chambers.

In order to facilitate accessibility of food items stored therein, the cabinet of the refrigerator appliance may contain multiple food storage chambers provided to store items of different sizes and/or at different conditions. In such appliances, multiple doors may be provided. Multiple doors can be provided in side-by-side, top and bottom, inner and outer arrangements, or various combinations thereof.

When doors of the refrigerator appliance are provided in an opposing relationship, e.g., side-by-side or French doors, it is desirable to maintain alignment of the opposing doors. The alignment of one or both doors in a set of opposing doors may need to be adjusted, e.g., due to variations from manufacturing and/or asymmetrical loading of the opposing doors. If the doors are out of alignment, the aesthetics of the refrigerator may be unpleasing and the effectiveness of the seal provided by the doors may be impaired. Accordingly, devices for adjusting the alignment of the refrigerator doors would be useful.

BRIEF DESCRIPTION

Additional aspects and advantages of the invention will be set forth in part in the following description, or may be apparent from the description, or may be learned through practice of the invention.

In a first exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a top portion and a bottom portion along the vertical direction, a first side portion and a second side portion along the lateral direction, and a front portion and a back portion along the transverse direction. The front portion of the first food storage chamber defines an opening for receipt of food items. The refrigerator appliance also includes a door positioned at the front portion of the food storage chamber and movable between a closed position and an open position to permit selective access to the food storage chamber. The refrigerator appliance also includes a hinge. The hinge includes a hinge bracket coupled to the cabinet. The hinge bracket includes a lateral plate. A pivot pin is received in the lateral plate of the hinge bracket. The pivot pin is oriented generally perpendicular to the lateral plate of the hinge bracket. The door is coupled to the pivot pin such that the door is rotatable with respect to the hinge bracket. A lateral surface of the door is spaced apart from the lateral plate of the hinge bracket along the vertical direction by a height. An adjustable spacer is positioned on the pivot pin between the lateral plate of the hinge bracket and the lateral surface of the door. The adjustable spacer is configured to adjust the height. The adjustable spacer includes a rotatable washer configured for rotating about the pivot pin and a fixed washer abutting the rotatable washer. The fixed washer is configured to engage the pivot pin such that the fixed washer is rotationally fixed with respect to the pivot pin. The rotatable washer includes a first adjustment cam defining a first inclined engagement surface and a second adjustment cam defining a second inclined engagement surface. The fixed washer includes a third adjustment cam defining a third inclined engagement surface and a fourth adjustment cam defining a fourth inclined engagement surface.

In a second exemplary embodiment, a hinge is provided. The hinge defines a vertical direction, a lateral direction, and a transverse direction. The vertical, lateral, and transverse directions are mutually perpendicular. The hinge includes a hinge bracket. The hinge bracket includes a lateral plate. A pivot pin is received in the lateral plate of the hinge bracket. The pivot pin is oriented generally perpendicular to the lateral plate of the hinge bracket. A bushing is coupled to the pivot pin such that the bushing is rotatable with respect to the first hinge bracket. A bottom surface of the bushing is spaced apart from the lateral plate of the hinge bracket along the vertical direction by a height. An adjustable spacer is positioned on the pivot pin between the lateral plate of the hinge bracket and the bottom surface of the bushing. The adjustable spacer is configured to adjust the height. The adjustable spacer includes a rotatable washer configured for rotating about the pivot pin and a fixed washer abutting the rotatable washer. The fixed washer is configured to engage the pivot pin such that the fixed washer is rotationally fixed with respect to the pivot pin. The rotatable washer includes a first adjustment cam defining a first inclined engagement surface and a second adjustment cam defining a second inclined engagement surface. The fixed washer includes a third adjustment cam defining a third inclined engagement surface and a fourth adjustment cam defining a fourth inclined engagement surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
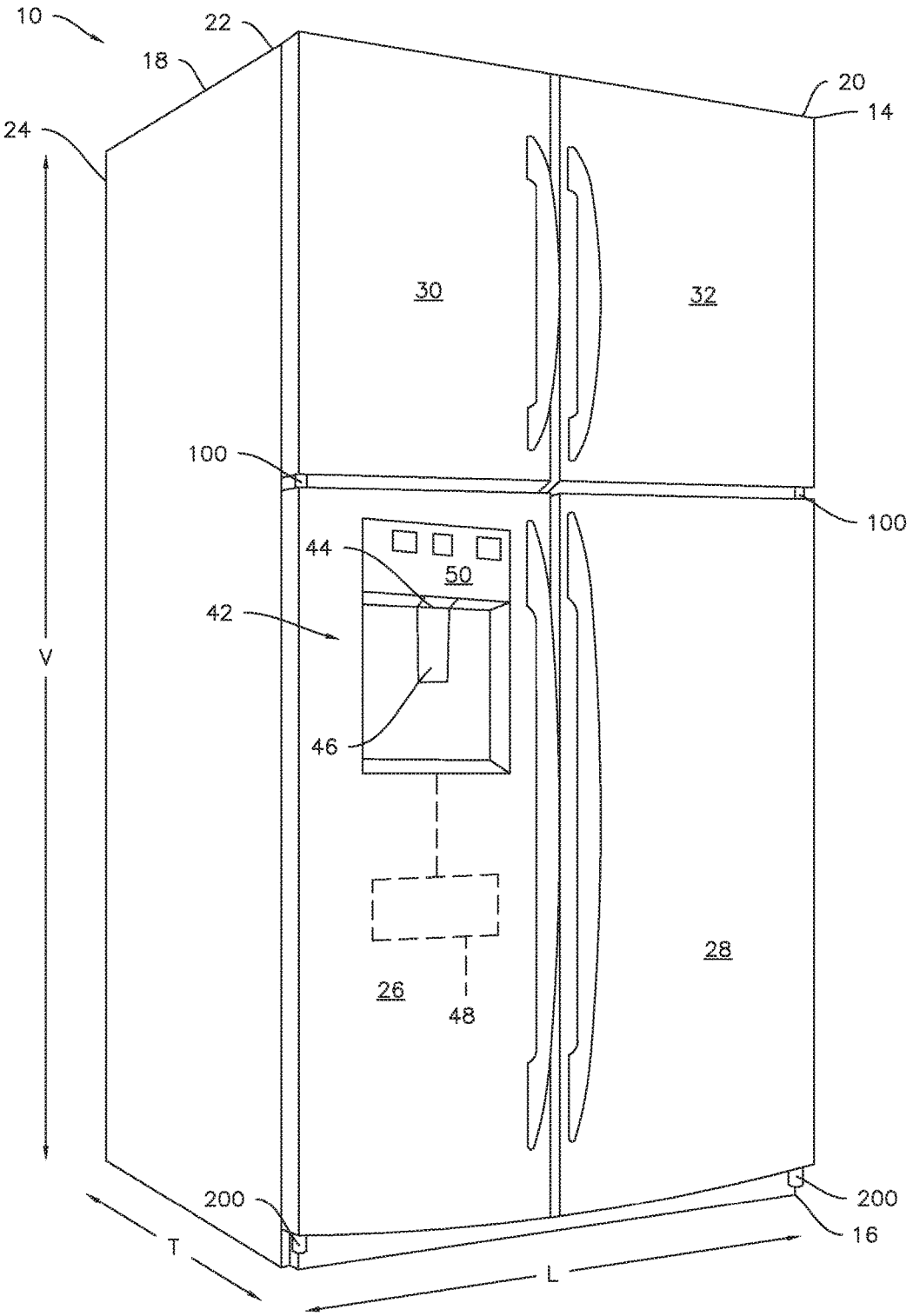
FIG. 1 provides a perspective view of a refrigerator appliance according to an exemplary embodiment of the present subject matter with the doors shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

FIG. 1 provides a perspective view of a refrigerator appliance 10 according to an exemplary embodiment of the present subject matter. Refrigerator appliance 10 defines a vertical direction V, a lateral direction L, and a transverse direction T, the vertical direction V, the lateral direction L, and the transverse direction T are mutually perpendicular. As may be seen in FIG. 2, refrigerator appliance 10 includes a housing or cabinet 12 that includes a first food storage chamber 34 and second food storage chamber 36. As depicted, the first and second food storage chambers 34, 36 are chilled chambers defined in the cabinet 12 for receipt of food items for storage. In some embodiments, cabinet 12 defines fresh food chamber 34 positioned at or adjacent bottom 16 of cabinet 12 and a frozen food storage chamber 36 arranged at or adjacent top 14 of cabinet 12. The illustrated exemplary refrigerator appliance 10 is generally referred to as a top mount refrigerator. It is recognized, however, that the benefits of the present disclosure apply to other types and styles of refrigerators such as, for example, a bottom mount refrigerator, a side-by-side style refrigerator, or a freezer appliance. Consequently, the description set forth herein is for illustrative purposes only and is not intended to be limiting in any aspect to a particular refrigerator chamber configuration.

Refrigerator doors 26 and 28 are rotatably mounted to cabinet 12, e.g., such that the doors permit selective access to fresh food storage chamber 34 of cabinet 12. As shown in the illustrated embodiments, refrigerator doors include a left refrigerator door 26 rotatably mounted to cabinet 12 at left side 18 of cabinet 12 and a right refrigerator door 28 rotatably mounted to cabinet 12 at right side 20 of cabinet 12. In embodiments including a pair of doors such as left refrigerator door 26 and right refrigerator door 28, e.g., sometimes referred to as French doors, a mullion 38 may be connected to one of the doors, e.g., left refrigerator door 26 as illustrated for example in FIG. 2. In the illustrated example of FIG. 2, when left refrigerator door 26 and right refrigerator door 28 are in the closed position, the mullion 38 will sealingly engage the right refrigerator door 28 to increase sealing of the gap between the left refrigerator door 26 and the right refrigerator door 28. As noted above, the benefits of the present disclosure apply to other types of refrigerators as well, for example, in other embodiments, a single refrigerator door may be provided, e.g., in a side-by-side or top or bottom mount configuration.

Figure 2:
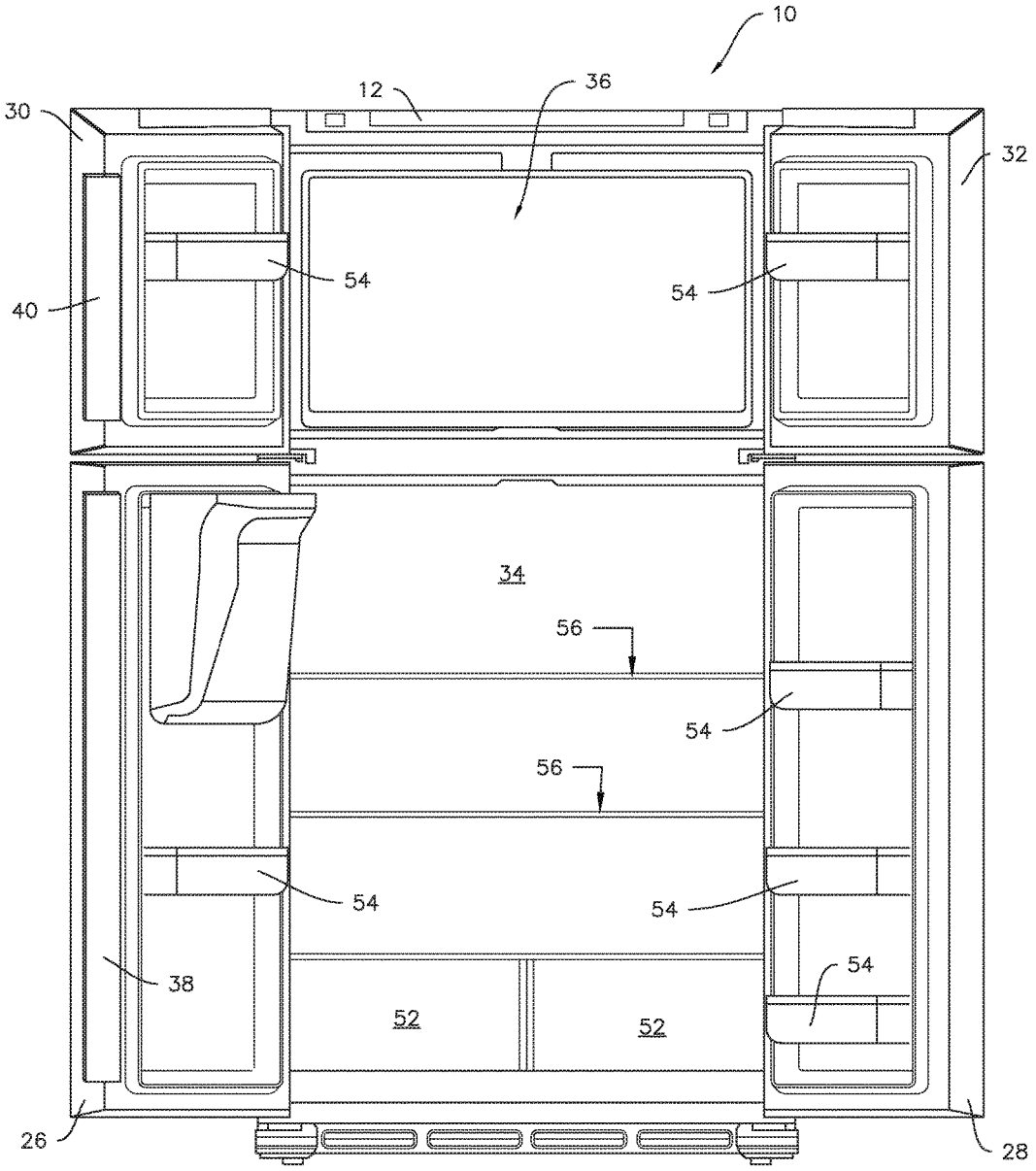
FIG. 2 provides a front elevation view of the exemplary refrigerator appliance of FIG. 1 with the doors of the exemplary refrigerator appliance shown in an open position.

Refrigerator doors 26 and 28 may be rotatably hinged to an edge of cabinet 12 for selectively accessing fresh food storage chamber 34. Similarly, freezer doors 30 and 32 may be rotatably hinged to an edge of cabinet 12 for selectively accessing frozen food storage chamber 36. To prevent leakage of cool air freezer doors 30 and 32 and/or cabinet 12 may define one or more sealing mechanisms (e.g., rubber gaskets, not shown) at the interface where the doors 30 and 32 meet cabinet 12. Such sealing mechanisms may include a mullion 40, similar to mullion 38 described above with respect to the refrigerator doors 26 and 28, in embodiments where a pair of freezer doors, e.g., a left freezer door 30 and a right freezer door 32 as illustrated in FIG. 2, are provided. Refrigerator doors 26, 28 and freezer doors 30, 32 are shown in the closed position in FIG. 1 and in the open position in FIG. 2. It should be appreciated that doors having a different style, location, or configuration are possible and within the scope of the present subject matter.

As will be described in more detail below, the refrigerator appliance may include one or more adjustable hinges, 100, and 200. For example, as illustrated in FIG. 1, embodiments of the refrigerator appliance 10 may include a left refrigerator door 26 and a right refrigerator door 28 as well as a left freezer door 30 and a right freezer door 32, e.g., two pairs of French doors, which may sometimes be referred to as a quad door configuration. Some or all of the doors 26, 28, 30, and 32 may be connected to the cabinet 12 with an adjustable hinge 100 or 200. For example, the illustrated embodiment in FIG. 1 is a double French door refrigerator appliance 10 including a pair of middle hinges 100 and a pair of bottom hinges 200, any or all of the hinges may be adjustable as described hereinbelow. In other example embodiments, the refrigerator appliance 10 may include a single door to selectively enclose the fresh food chamber and in such embodiments the refrigerator appliance 10 may be provided with only one corresponding adjustable hinge 100 or 200 connecting the single door to the cabinet 12.

FIG. 2 provides a front view of refrigerator appliance 10 with refrigerator doors 26, 28 and freezer doors 30, 32 shown in an open position. According to the illustrated embodiment, various storage components are mounted within fresh food chamber 34 and freezer chamber 36 to facilitate storage of food items therein as will be understood by those skilled in the art. In particular, the storage components include drawers 52, bins 54, and shelves 56 that are mounted within fresh food storage chamber 34 or frozen food storage chamber 36. Drawers 52, bins 54, and shelves 56 are configured for receipt of food items (e.g., beverages and/or solid food items) and may assist with organizing such food items. As an example, drawers 52 of fresh food chamber 34 can receive fresh food items (e.g., vegetables, fruits, and/or cheeses) and increase the useful life of such fresh food items.

Refrigerator appliance 10 may also include a dispensing assembly 42 for dispensing liquid water and/or ice. Dispensing assembly 42 may be positioned on or mounted to an exterior portion of refrigerator appliance 10, e.g., on one of refrigerator doors 26 or 28. Dispensing assembly 42 includes a discharging outlet 44 for accessing ice and liquid water. An actuating mechanism 46, shown as a paddle, is mounted below discharging outlet 44 for operating dispensing assembly 42. In alternative exemplary embodiments, any suitable actuating mechanism may be used to operate dispensing assembly 42. For example, dispensing assembly 42 can include a sensor (such as an ultrasonic sensor) or a button rather than the paddle. A control panel 50 is provided for controlling the mode of operation. For example, control panel 50 includes a plurality of user inputs (not labeled), such as a water dispensing button and an ice-dispensing button, for selecting a desired mode of operation such as crushed or non-crushed ice.

Refrigerator appliance 10 further includes a controller 48. Operation of the refrigerator appliance 10 is regulated by controller 48 that is operatively coupled to control panel 50. In some exemplary embodiments, control panel 50 may represent a general purpose I/O ("GPIO") device or functional block. In some exemplary embodiments, control panel 50 may include input components, such as one or more of a variety of electrical, mechanical or electro-mechanical input devices including rotary dials, push buttons, touch pads, and touch screens. Control panel 50 can be communicatively coupled with controller 48 via one or more signal lines or shared communication busses. Control panel 50 provides selections for user manipulation of the operation of refrigerator appliance 10. In response to user manipulation of the control panel 50, controller 48 operates various components of refrigerator appliance 10. For example, controller 48 is operatively coupled or in communication with various components of a sealed refrigeration system, e.g., to set or adjust temperatures within the cabinet 12, such as within the fresh food storage chamber 34. Controller 48 may also be communicatively coupled with a variety of sensors, such as, for example, chamber temperature sensors or ambient temperature sensors. Controller 48 may receive signals from these temperature sensors that correspond to the temperature of an atmosphere or air within their respective locations.

Controller 48 includes memory and one or more processing devices such as microprocessors, CPUs or the like, such as general or special purpose microprocessors operable to execute programming instructions or micro-control code associated with operation of refrigerator appliance 10. The memory can represent random access memory such as DRAM, or read only memory such as ROM or FLASH. The processor executes programming instructions stored in the memory. The memory can be a separate component from the processor or can be included onboard within the processor. Alternatively, controller 48 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
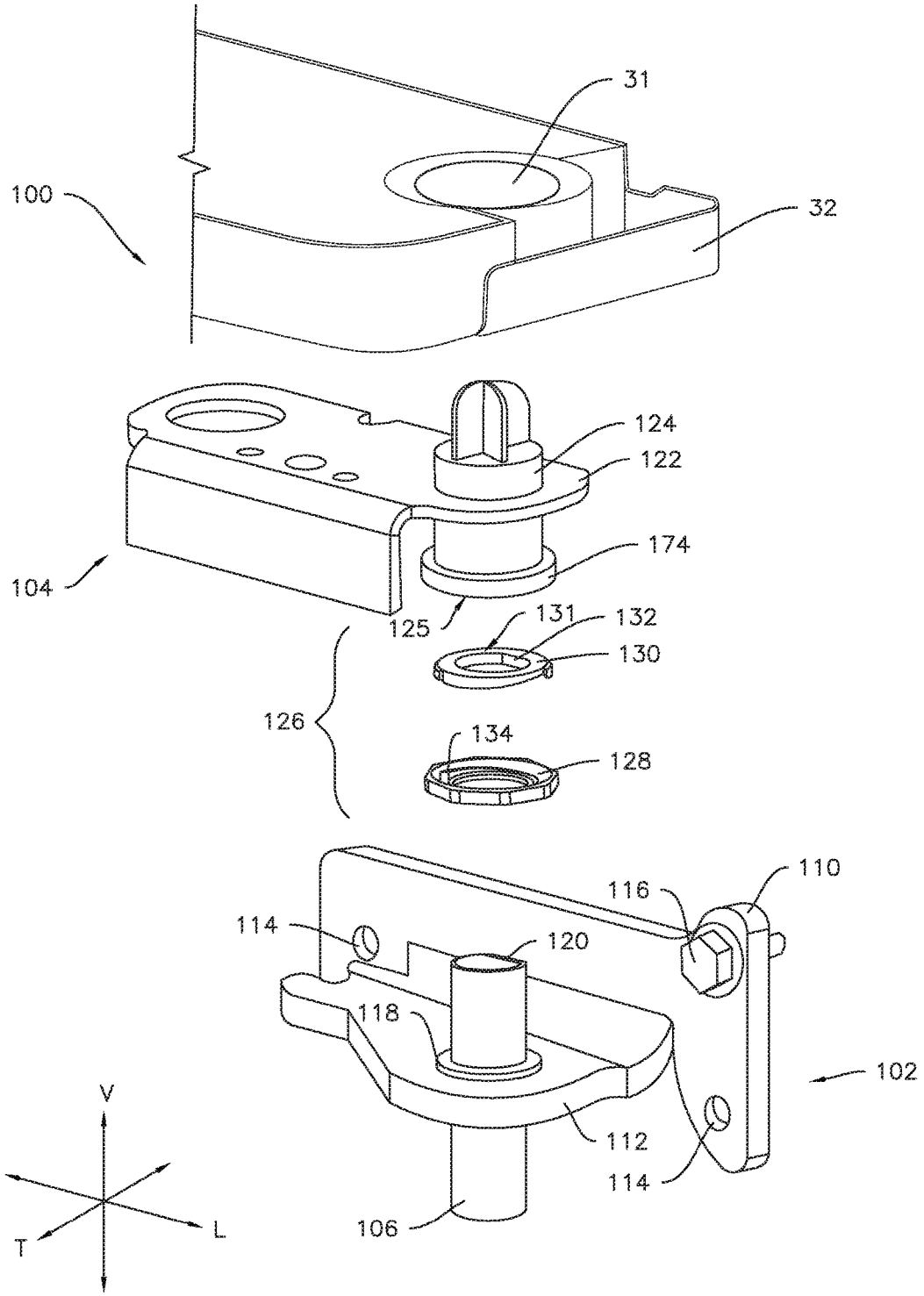
FIG. 3 provides an exploded view of an adjustable hinge assembly according to one or more embodiments of the present disclosure.

FIG. 3 provides an exploded view of an adjustable hinge 100. In particular, the adjustable hinge 100 of FIG. 3 may be a middle hinge between one of the refrigerator doors 26 or 28 (FIG. 1) and a corresponding freezer door 30 or 32, e.g., left refrigerator door 26 and left freezer door 30. For example, as illustrated in FIG. 3, the adjustable hinge 100 may be a right middle hinge, e.g., the adjustable hinge 100 may be positioned between the right refrigerator door 28 and the right freezer door 32. Only a portion of the right freezer door 32 is depicted in FIG. 3 for sake of clarity.

As illustrated in FIG. 3, the adjustable hinge 100 includes at least one hinge bracket 102. In some embodiments, the hinge bracket 102 may be a first hinge bracket and the adjustable hinge 100 may include first hinge bracket 102 and a second hinge bracket 104. The first hinge bracket 102 may include a vertical plate 110 and a lateral plate 112 oriented generally perpendicular to the vertical plate 110. The first hinge bracket 102 may be coupled to the cabinet 12, for example, the vertical plate 110 may include apertures 114 for receiving fasteners 116 (only one fastener 116 is depicted in FIG. 3 for clarity of illustration) for fastening the vertical plate 110 to the cabinet 12 of the refrigerator appliance 10. As used herein, terms of approximation, such as "generally," or "about" are to be understood as including within ten percent greater or less than the stated amount. Further, such terms when used in the context of an angle or direction are to be understood as including within ten degrees greater or less than the stated angle or direction. For example, "generally perpendicular" is to be understood as encompassing angles ranging from eighty degrees to one hundred degrees.

A pivot pin 106 may be received in the first hinge bracket 102, such as in the lateral plate 112 of the first hinge bracket 102. The pivot pin 106 may be oriented generally perpendicular to the lateral plate 112 of the first hinge bracket 102, e.g., generally along the vertical direction V. The pivot pin 106 may include a flange 118 to limit the insertion of the pivot pin 106 into the lateral plate 112. The pivot pin 106 is rotationally fixed with respect to the first hinge bracket 102. For example, in some embodiments, a clip 108 (FIG. 6) may be provided to secure the pivot pin 106 to the lateral plate 112 of the first hinge bracket 102.

Still with reference to FIG. 3, in embodiments where the second hinge bracket 104 is provided, the second hinge bracket 104 may include a lateral plate 122. The second hinge bracket 104 generally serves as a door stop, e.g., may limit the rotational travel of the door 30 or 32. The second hinge bracket 104 may be coupled to a door of the refrigerator appliance 10, e.g., one of the freezer doors 30 or 32, e.g., right freezer door 32 as in the illustrated example of FIG. 3. In such embodiments, the second hinge bracket 104, and in particular the lateral plate 122, may serve to reinforce the bottom of the door 30 or 32, and may serve to distribute forces on the door 30 or 32 when the door 30 or 32 rotates between the open position and the closed position. For example, the lateral plate 122 of the second hinge bracket 104 may be fastened to the door in a similar manner as described above with respect to the first hinge bracket 104 and the cabinet 12. The structure and function of fasteners, e.g., the illustrated example fastener 116, is generally understood by those of skill in the art, and as such will not be described in further detail herein.

As noted above, the second hinge bracket 104 and the lateral plate 122 of the second hinge bracket 104 may be provided to reinforce the door 30 or 32, e.g., when the door 30 or 32 comprises a plastic material. In other embodiments, the door 30 or 32 may comprise other materials, such as a metal material, and the second hinge bracket 104 may not be provided, or may be provided only as a door stop, e.g., without the lateral plate 122.

In various embodiments, the door 32 may be coupled to the pivot pin 106 such that the door 32 is rotatable about the pivot pin 106 with respect to the first hinge bracket 102. For example, as illustrated in FIG. 3, in some embodiments, the door 32 may be coupled to the pivot pin 106 via the second hinge bracket 104. For example, a bushing 124 may be received in a rounded slot 31 of the door 32 and/or in the lateral plate 122 of the second hinge bracket 104 and the pivot pin 106 may be received within the bushing 124.

Figure 6:
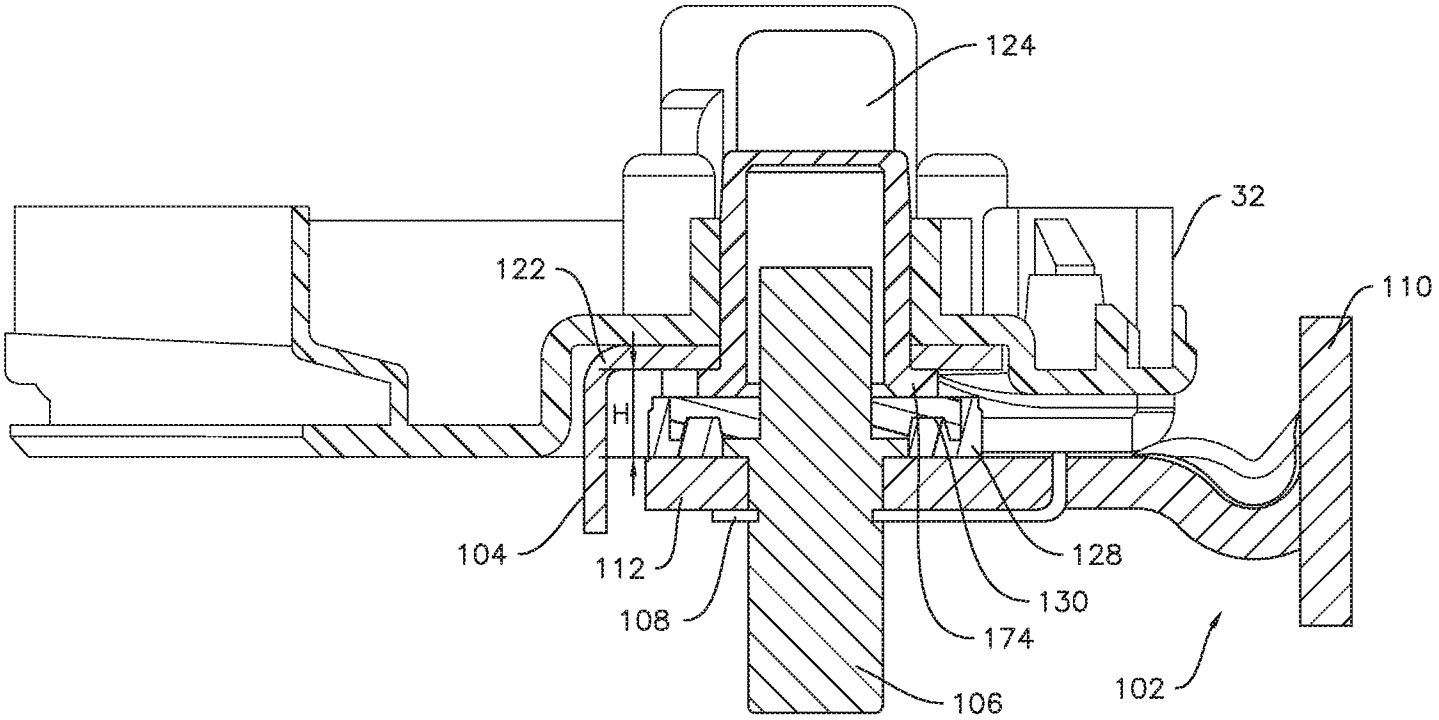
FIG. 6 provides a section view of the hinge assembly of FIG. 3.

As seen in FIG. 6, in an assembled position, lateral plate 112 of the first hinge bracket 102 may be spaced apart from a lateral surface of the door 32 along the vertical direction V by a height H. For example, as illustrated in FIG. 6, the lateral surface of the door 32 may be provided by the lateral plate 122 of the second hinge bracket 104, e.g., in embodiments where the lateral plate 122 serves as a reinforcing plate of the door 32. The height H may be at least partially defined by an adjustable spacer 126 positioned between the lateral plate 112 of the first hinge bracket 102 and the lateral plate 122 of the second hinge bracket 104. For example, the adjustable spacer 126 may be positioned on or around the pivot pin 106. In some embodiments, the adjustable spacer 126 may define a generally annular shape or other hollow shape including a central void or opening, such that the pivot pin 106 may pass through the central opening of the adjustable spacer 126. A top surface 131 (FIG. 3) of the adjustable spacer 126 may abut a bottom surface 125 (FIG. 3) of the bushing 124. In particular, the bushing 124 may have a flange 174 positioned at a bottom of the bushing 124 such that the bottom surface 125 of the bushing 124 is at least partially defined by the flange 174. Only a portion of the right freezer door 32 is depicted in FIG. 6 for sake of clarity.

Figure 5:
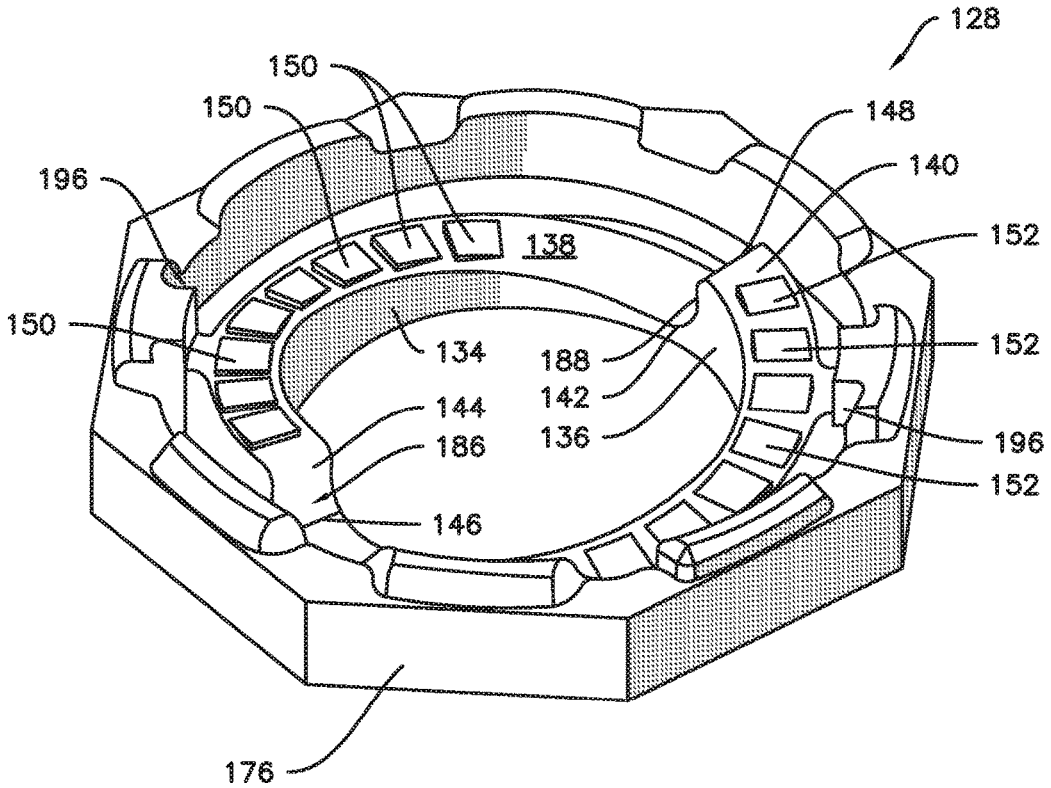
FIG. 5 provides a perspective view of a rotatable washer according to one or more embodiments of the present disclosure.

The adjustable spacer 126 may be configured to adjust the height H, e.g., the vertical spacing between the lateral plate 122 of the second hinge bracket 104 and the lateral plate 112 of the first hinge bracket 102. In some embodiments, the adjustable spacer 126 may include a rotatable washer 128 configured for rotating about the pivot pin 106 and a fixed washer 130 abutting the rotatable washer 128. The rotatable washer 128 may include a plurality of engagement means 176 disposed around an exterior perimeter of the rotatable washer 128. For example, the engagement means 176 may include flats, as illustrated in FIG. 5, configured to be engaged by a wrench or other tool or a user's fingers in order to rotated the rotatable washer 128 and thereby adjust the height H of the hinge 100. In other embodiments, the engagement means 176 may include knurling, ridges, or any other structure suitable for enhancing the ease of manipulating the rotatable washer 128.

The fixed washer 130 may be configured to engage the pivot pin 126 such that the fixed washer 130 is rotationally fixed with respect to the pivot pin 106. In some embodiments, for example as illustrated in FIG. 3, the fixed washer 130 may include a flat 132 configured for engaging a flat 120 on the pivot pin 106 to prevent or minimize relative rotation of the fixed washer 130 and the pivot pin 106. In other embodiments, the fixed washer 130 and the pivot pin 106 may include splines, a slot and key configuration, or any other suitable structure to prevent or minimize relative rotation of the fixed washer 130 and the pivot pin 106.

FIG. 5 provides a view of an engagement side of an exemplary rotatable washer 128. As best seen in FIG. 5, the rotatable washer 128 may include a first adjustment cam 134 defining a first inclined engagement surface 138 and a second adjustment cam 136 defining a second inclined engagement surface 140. The first inclined engagement surface 138 extends circumferentially around the rotatable washer 128 between a first low point 142 and a first high point 144, the second inclined engagement surface 140 extends circumferentially around the rotatable washer 128 between a second low point 146 adjacent the first high point 144 and a second high point 148 adjacent the first low point 142. The first high point 144 and the second low point 146 may be adjacent and offset and such that a vertical face 186 is defined therebetween. Similarly, the second high point 148 and the first low point 142 may be offset such that a vertical face 188 is defined between the second high point 148 and the first low point 142.

In some embodiments, the first and second inclined engagement surfaces 138, 140 may be duplicates of one another. For example, the vertical extent of the first high point 144 may be equal to the vertical extent of the second high point 148, and the first and second high points 144, 148 may be coplanar in a plane defined by the lateral direction L and the transverse direction T. Similarly, the first low point 142 may be coplanar with the second low point 146 in a plane parallel to the common plane of the first high point 144 and the second high point 148. Accordingly, the vertical extent of the first inclined engagement surface 138 may be the same as the vertical extent of the second inclined engagement surface 140. Further, the first and second inclined engagement surfaces 138 and 140 preferably extend around the circumference of the rotatable washer 128 to the same degree. For example, the first and second inclined engagements surfaces 138 and 140 may each subtend an angle of about one hundred and eighty degrees.

In some embodiments, the first inclined engagement surface 138 may define a height along the vertical direction V. In such embodiments, the height of the first inclined engagement surface 138 may increase continuously from the first low point 142 to the first high point 144. In some embodiments, the second inclined engagement surface 140 may define a height along the vertical direction V. In such embodiments, the height of the second inclined engagement surface 140 may increases continuously from the second low point 146 to the second high point 148.

Figure 4:
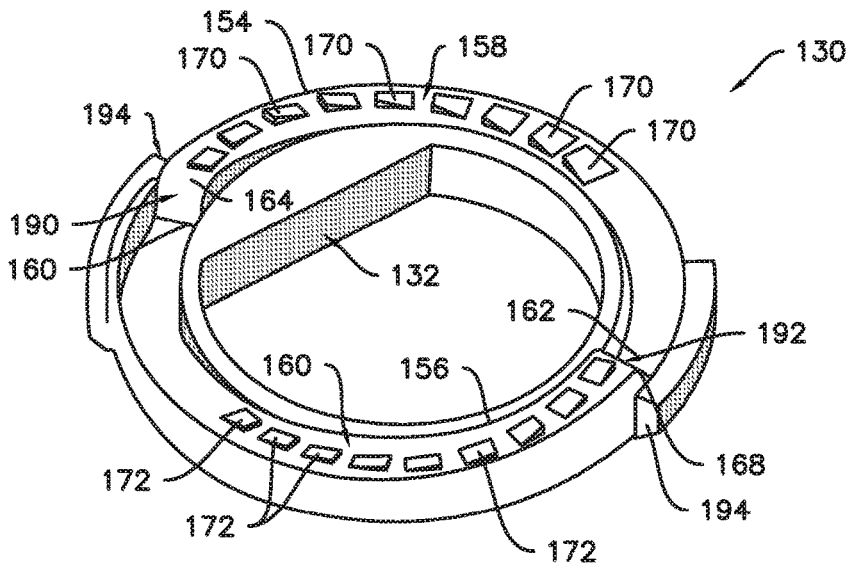
FIG. 4 provides a perspective view of a fixed washer according to one or more embodiments of the present disclosure.

Turning now to FIG. 4, an engagement side view of an exemplary fixed washer 130 is provided. Accordingly, it should be understood that when the hinge 100 is assembled, the engagement side of the fixed washer 130 shown in FIG. 4 may be superimposed on the engagement side of the rotatable washer 128 as shown in FIG. 5. For example, the rotatable washer 128 and the fixed washer 130 may be positioned such that the various surfaces and other features of the fixed washer 130 depicted in FIG. 4 may be aligned with similar corresponding surfaces and other features of the rotatable washer 128 depicted in FIG. 5, as will be described in more detail in the following. For example, the engagement side of the fixed washer 130 may be a bottom side of the fixed washer 130 and the engagement side of the rotatable washer 128 may be a top side of the rotatable washer 128. In such embodiments, when the hinge 100 is assembled (FIG. 6), the rotatable washer 128 may be positioned proximate to the first hinge bracket 102 and the fixed washer 130 may be positioned proximate to the second hinge bracket 104.

As illustrated, the fixed washer 130 may include a third adjustment cam 154 defining a third inclined engagement surface 158 and a fourth adjustment cam 156 defining a fourth inclined engagement surface 160. The third adjustment cam 154 and the fourth adjustment cam 156 may be duplicates of one another and of the first and second adjustment cams 134 and 136 of the rotatable washer 128 such that the inclined engagement surfaces 138, 140, 158, and 160 may be mutually superimposed. The third inclined engagement surface may extend circumferentially around the fixed washer 130 between a third low point 162 and a third high point 164, and the fourth inclined engagement surface 160 may extend circumferentially around the fixed washer 130 between a fourth low point 166 adjacent the third high point 164 and a fourth high point 168 adjacent the third low point 162. The third high point 164 and the fourth low point 166 may be adjacent and offset and such that a vertical face 190 is defined therebetween. Similarly, the fourth high point 168 and the third low point 162 may be offset such that a vertical face 192 is defined between the fourth high point 168 and the third low point 162.

In some embodiments, the third and fourth inclined engagement surfaces 158, 160 may be duplicates of one another. For example, the vertical extent of the third high point 164 may be equal to the vertical extent of the fourth high point 168, and the third and fourth high points 164, 168 may be coplanar in a plane defined by the lateral direction L and the transverse direction T. Similarly, the third low point 162 may be coplanar with the fourth low point 166 in a plane parallel to the common plane of the third high point 164 and the fourth high point 168. Accordingly, the vertical extent of the third inclined engagement surface 158 may be the same as the vertical extent of the fourth inclined engagement surface 160. Further, the third and fourth inclined engagement surfaces 158 and 160 preferably extend around the circumference of the fixed washer 130 to the same degree. For example, the third and fourth inclined engagements surfaces 158 and 160 may each subtend an angle of about one hundred and eighty degrees.

In some embodiments, the third inclined engagement surface 158 may define a height along the vertical direction V. In such embodiments, the height of the third inclined engagement surface 158 may increase continuously from the third low point 162 to the third high point 164. In some embodiments, the fourth inclined engagement surface 160 may define a height along the vertical direction V. In such embodiments, the height of the fourth inclined engagement surface 160 may increase continuously from the fourth low point 166 to the fourth high point 168.

As shown in FIGS. 4 and 5, the hinge assembly 100 may further include a first plurality of detents 150 formed on the first inclined engagement surface 138, a second plurality of detents 152 formed on the second inclined engagement surface 140, a third plurality of detents 170 formed on the third inclined engagement surface 158, and a fourth plurality of detents 172 formed on the fourth inclined engagement surface 160. The detents 150, 152, 170, and 172 may advantageously permit the rotatable washer 128 and the fixed washer 130 to remain in a desired position to provide the desired alignment of the corresponding door 26, 28, 30, or 32, with which the hinge 100 is associated.

Figure 11:
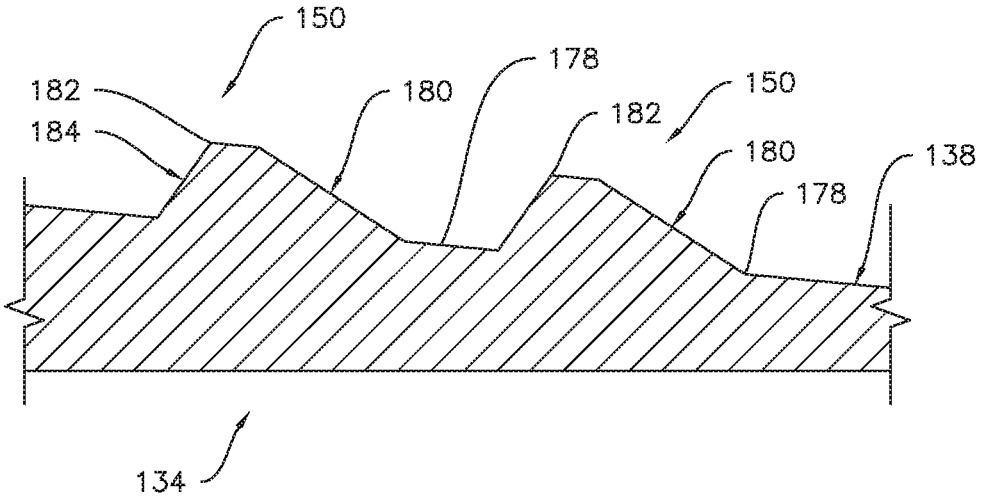
FIG. 11 provides a section view of an adjustment cam according to one or more embodiments of the present disclosure.

FIG. 11 illustrates an example embodiment of such detents. In particular, FIG. 11 illustrates an example embodiment of the first plurality of detents 150 formed on the first inclined engagement surface 138 of the first adjustment cam 134. However, it should be understood that the second, third, and fourth pluralities of detents 152, 170, and 172 may be similarly configured as shown and described herein with respect to the first plurality of detents 150. As illustrated in FIG. 11, each detent 150 of the first plurality of detents 150 may extend along the vertical direction V between a root 178 and a crest 182. Further, each detent 150 of the first plurality of detents 150 may include a retention face 184 and a sliding face 180 oblique to the retention face 184. As illustrated in FIG. 11, the retention face 184 defines a vertical extent along the vertical direction V and a horizontal extent within a plane defined by the lateral direction L and the transverse direction T. The horizontal extent of the retention face 184 is much smaller than the vertical extent of the retention face 184. As the retention face 184 extends upwards from the inclined engagement surface 138 along the vertical direction, the retention face 184 also extends along the horizontal direction in a direction opposing the slope of the inclined engagement surface 138. Accordingly, the retention face 184 may inhibit relative rotation of the rotatable washer 128 with respect to fixed washer 130, e.g., due to the force of gravity. However, the slope of the retention face 184 may be configured to allow rotation of the rotatable washer 128 with respect to fixed washer 130 in order to reduce the height of the adjustable spacer 126 when sufficient force is applied. For example, where the retention face 184 is not completely vertical, a user may apply sufficient force to overcome the resistance provided by the retention face 184. As illustrated, the sliding face 180 may extend generally between the root 178 and the crest 182. The root 178 of the detent 150 may be defined at an intersection of the sliding face 180 and the inclined engagement surface 138. In some embodiments the crest 182 may be defined at the largest vertical extent of the retention face 184. In some embodiments, as illustrated in FIG. 11, the largest vertical extent of the retention face 184 may be offset from the largest vertical extent of the sliding face 180. In other embodiments, the sliding face 180 may directly intersect the retention face 184. In various example embodiments, the crest 182 of the detent may be defined at an intersection of the sliding face 180 and the retention face 184. It should be noted that the detents 150 may take other forms, such as but not limited to dimples, divots, or any other suitable form.

When the hinge 100 is assembled, e.g., as illustrated in FIG. 6, the adjustable spacer 126 may be installed such that the engagement sides of the rotatable washer 128 and the fixed washer 130 are abutting. For example, the fixed washer 130 and the rotatable washer 128 may be positioned such that the first adjustment cam 134 and the second adjustment cam 136 abut the third adjustment cam 154 and the fourth adjustment cam 156. In some embodiments, the inclined engagement surfaces 138, 140, 158, and 160 may be duplicates of one another such that the surfaces may be placed in an abutting relationship and maintain contact between the rotatable washer 128 and the fixed washer 130 over a continuous contact surface, e.g., all or a substantial portion of the inclined engagement surfaces 138, 140, 158, and 160, as the rotatable washer 128 may rotate between various positions relative to the fixed washer 130. Further, when the inclined engagement surfaces 138, 140, are placed in an abutting relationship, the first and second plurality of detents 150 and 152 may be positioned to engage the third and fourth plurality of detents 170 and 172. For example, in some embodiments, the rotatable washer 128 may be rotatable around the pivot pin 106 between a first position and a second position. In such embodiments, when the rotatable washer 128 is in the first position, the third low point 162 may abut the first high point 114, the third high point 164 may abut the first low point 142, the fourth low point 166 may abut the second high point 148, and the fourth high point 168 may abut the second low point 146. In such embodiments, when the rotatable washer 128 is in the second position, the third high point 164 may be adjacent to the first high point 144 and the fourth high point 168 may be adjacent to the second high point 148. The inclined engagement surfaces 138, 140, 158, and 160, as noted above, may be duplicates of each other, which may advantageously permit the inclined engagement surfaces 138, 140, 158, and 160 to remain in contact over all or a substantial portion of the circumferential extent of each of the inclined engagement surfaces 138, 140, 158, and 160. Such surface contact is advantageous, for example, as compared to point contact between the adjustment cams 134, 136, 154, and/or 156 because point contact may create undesirable stress concentrations in one or both of the washers 128 and 130.

In order to prevent rotation of the rotatable washer 128 beyond the second position opposing rotation stops 194 and 196 may be provided on the fixed washer 130 and the rotatable washer 128, respectively, for example as illustrated in FIGS. 4 and 5. Accordingly, surface contact between inclined engagement surfaces 138, 140, 158, and 160, as described above, may be maintained throughout all possible relative positions of the rotatable washer 128 and the fixed washer 130.

Figure 7:
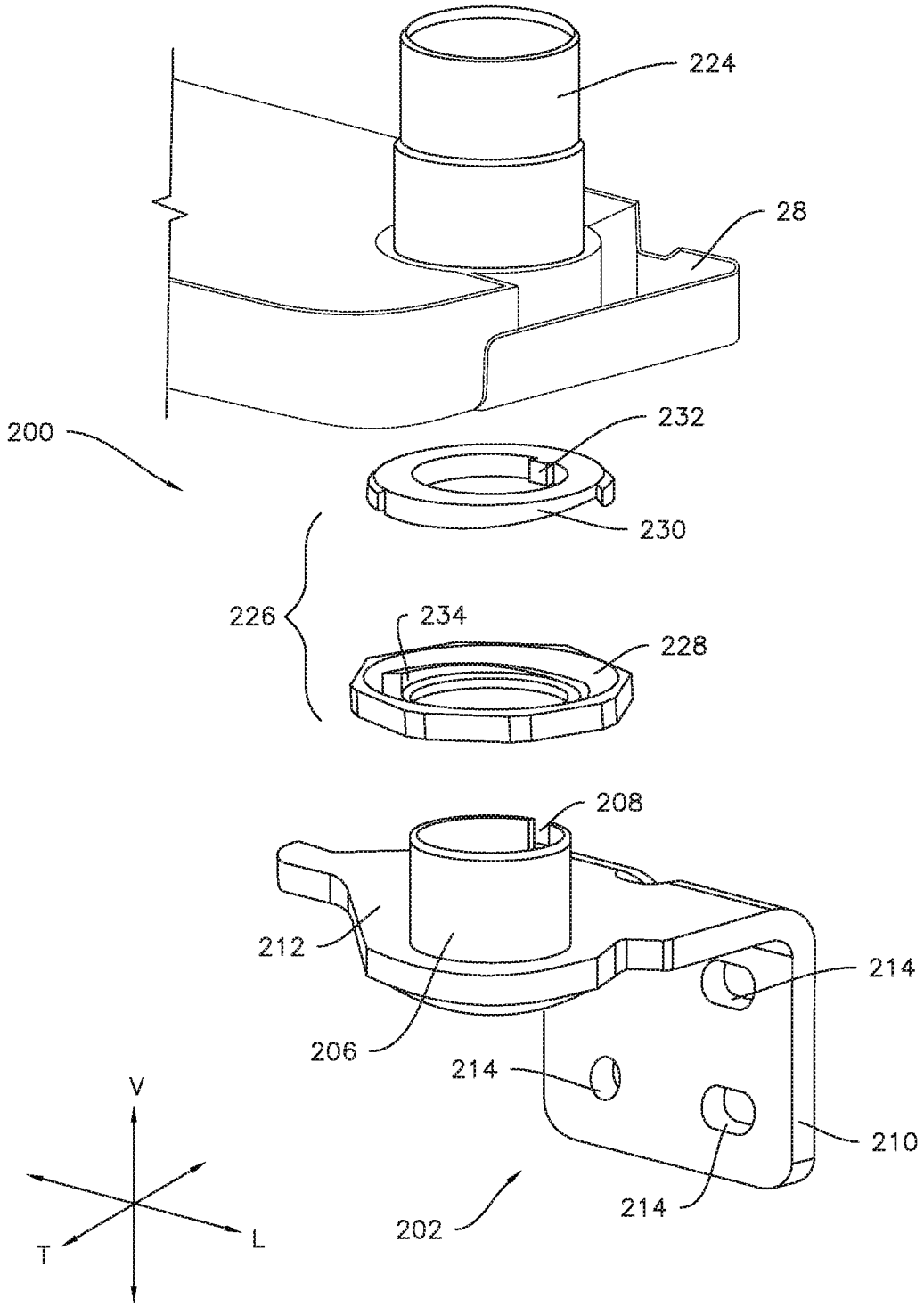
FIG. 7 provides an exploded view of an adjustable hinge assembly according to one or more embodiments of the present disclosure.
Figure 10:
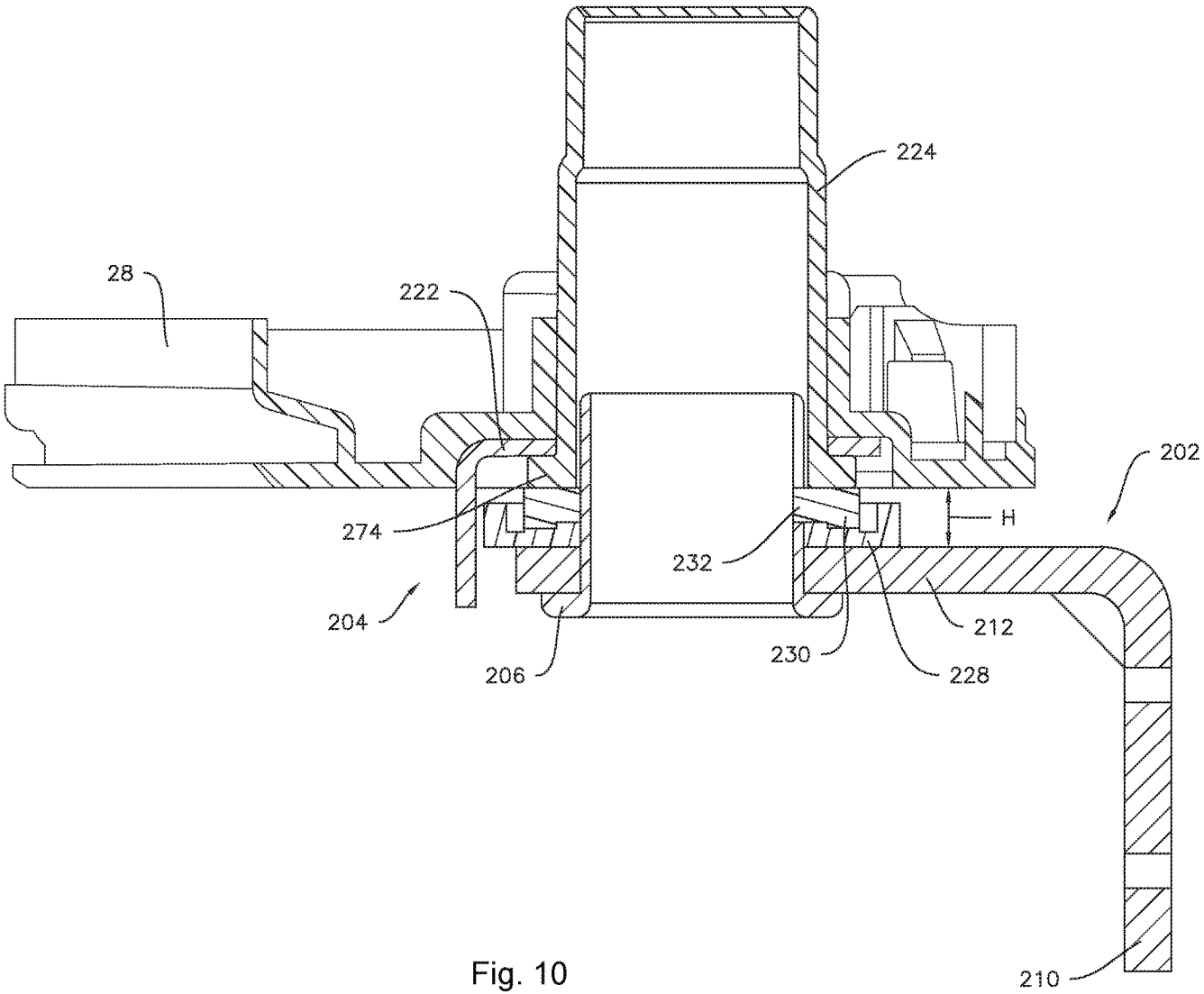
FIG. 10 provides a section view of the hinge assembly of FIG. 7.

As illustrated in FIGS. 7 and 10, some embodiments may include an adjustable hinge 200, which may be provided as a bottom hinge (e.g., FIG. 1) coupled to one of the refrigerator doors 26 or 28. For example, as illustrated in FIG. 7, the adjustable hinge 200 may be a right bottom hinge, e.g., the adjustable hinge 200 may be positioned below the right refrigerator door 28. Only a portion of the right refrigerator door 28 is depicted in FIGS. 7 and 10 for sake of clarity.

Figure 8:
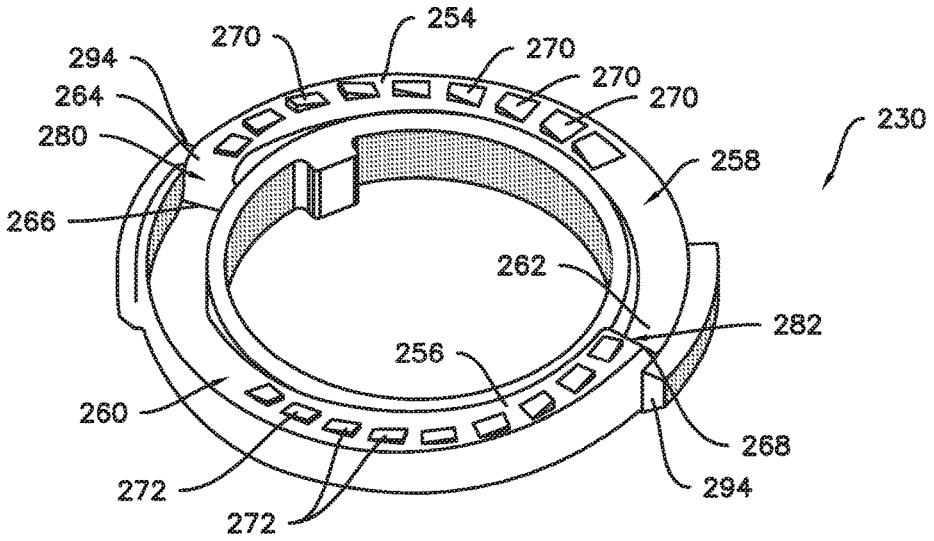
FIG. 8 provides a perspective view of a fixed washer according to one or more embodiments of the present disclosure.
Figure 9:
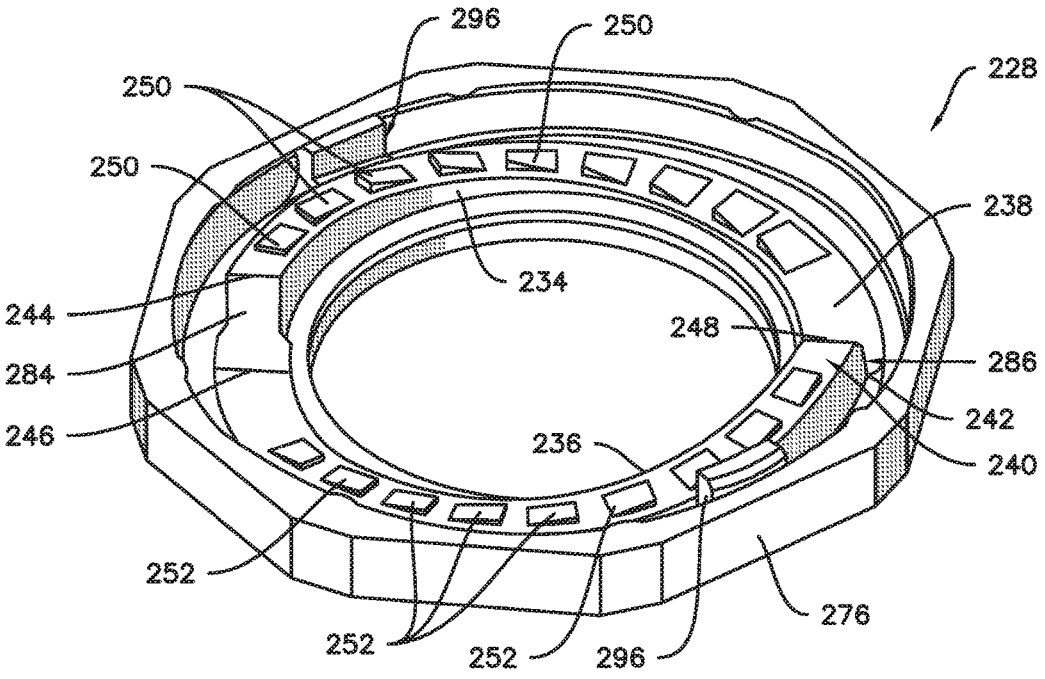
FIG. 9 provides a perspective view of a rotatable washer according to one or more embodiments of the present disclosure.

The adjustable hinge 200 may be similar to the adjustable hinge 100 described in the foregoing in many respects. Accordingly, the details set forth above with respect to the adjustable hinge 100 may be included in the adjustable hinge 200 as well, but are not repeated herein for sake of brevity and clarity. For example, the adjustable hinge 200 may include an adjustable spacer 226 similar to the adjustable spacer 126 described above. The adjustable spacer 226 may include, as illustrated in FIGS. 7 through 9, a rotatable washer 228 configured for rotating about the pivot pin 206 and a fixed washer 230 abutting the rotatable washer 228. Each of the rotatable washer 228, the pivot pin 206, and the fixed washer 230 may be similar to the rotatable washer 128, the pivot pin 106, and the fixed washer 130 of hinge 100 as described hereinabove. For example, the rotatable washer 228 may include engagement means 276 similar to the engagement means 176 described above. As illustrated in FIGS. 7 and 8, in some embodiments, the hinge 200 may include a fixed washer 230 including a key 232 and a pivot pin 206 including a slot 208 configured to engage the key 232 in order to prevent or minimize relative rotation between the fixed washer 230 and the pivot pin 206. As illustrated in FIGS. 7 and 10, the pivot pin 206 may extend predominantly only on one side of the lateral plate 212, whereas the pivot pin 106 of the hinge 100 may extend on both sides of the lateral plate 112. Where hinge 200 is configured as a bottom hinge, the pivot pin 206 may not extend substantially below the lateral plate 212 as there is no door below the lateral plate 212, in contrast to the hinge 100 which may be configured as a middle hinge, wherein the pivot pin 106 may extend below the lateral plate 112, e.g., to engage one of the refrigerator doors 26 or 28. Pivot pin 206 may be rotationally fixed to first hinge bracket 202 in a similar manner as described above with respect to pivot pin 106 and hinge bracket 102. In other embodiments, for example as illustrated in FIG. 10, pivot pin 206 may form an interference fit with the lateral plate 212 of the hinge bracket 202. For example, the pivot pin 206 may be staked, swaged, or otherwise deformed after being placed in lateral plate 212 to create the interference fit with the lateral plate 212.

As illustrated in FIG. 7, the hinge 200 may include a first hinge bracket 202 comprising a vertical plate 210 with apertures 214 therein and a lateral plate 212. The first hinge bracket 202 may be similar to the first hinge bracket 102 of the hinge 100 as described hereinabove and may be similarly coupled to the cabinet 12, e.g., using fasteners. As shown in FIG. 10, the hinge 200 may also include a bushing 224 having a flange 274, similar to the bushing 124 and flange 174 described above, and a second hinge bracket 204 comprising a lateral plate 222, similar to the second hinge bracket 104 and lateral plate 122 described above. As shown in FIGS. 8 and 9, the washer 228 and 230 may be similar to the washers 128 and 130 described above, including first and second adjustment cams 234 and 236 and third and fourth adjustment cams 254 and 256 may be similar to the first and second adjustment cams 134 and 136 and third and fourth adjustment cams 154 and 156 as described above.

Also as shown in FIGS. 8 and 9, the first and second adjustment cams 234 and 236 may include a first inclined engagement surface 238 and a second inclined engagement surface 240. The first inclined engagement surface 238 extends circumferentially around the rotatable washer 228 between a first low point 242 and a first high point 244, the second inclined engagement surface 240 extends circumferentially around the rotatable washer 228 between a second low point 246 adjacent the first high point 244 and a second high point 248 adjacent the first low point 242. The first high point 244 and the second low point 246 may be adjacent and offset and such that a vertical face 284 is defined therebetween. Similarly, the second high point 248 and the first low point 242 may be offset such that a vertical face 286 is defined between the second high point 248 and the first low point 242. Further, the first and second inclined engagement surfaces 238 and 240 may be duplicates of one another and may each define continuously increasing vertical heights, as described above with respect to the first and second inclined engagement surfaces 138 and 140.

As illustrated for example in FIG. 8, the fixed washer 230 may include a third adjustment cam 254 defining a third inclined engagement surface 258 and a fourth adjustment cam 256 defining a fourth inclined engagement surface 260. The third adjustment cam 254 and the fourth adjustment cam 256 may be duplicates of one another and of the first and second adjustment cams 234 and 236 of the rotatable washer 228 such that the inclined engagement surfaces 238, 240, 258, and 260 may be mutually superimposed. The third inclined engagement surface 258 may extend circumferentially around the fixed washer 230 between a third low point 262 and a third high point 264, and the fourth inclined engagement surface 260 may extend circumferentially around the fixed washer 230 between a fourth low point 266 adjacent the third high point 264 and a fourth high point 268 adjacent the third low point 262. The third high point 264 and the fourth low point 266 may be adjacent and offset and such that a vertical face 280 is defined therebetween. Similarly, the fourth high point 268 and the third low point 262 may be offset such that a vertical face 282 is defined between the fourth high point 268 and the third low point 262. Further, the third and fourth inclined engagement surfaces 258 and 260 may be duplicates of one another and may each define continuously increasing vertical heights, as described above with respect to the third and fourth inclined engagement surfaces 158 and 160.

Referring again to FIGS. 8 and 9, the hinge assembly 200 may further include a first plurality of detents 250 formed on the first inclined engagement surface 238, a second plurality of detents 252 formed on the second inclined engagement surface 240, a third plurality of detents 270 formed on the third inclined engagement surface 258, and a fourth plurality of detents 272 formed on the fourth inclined engagement surface 260. The detents 250, 252, 270, and 272 may advantageously permit the rotatable washer 228 and the fixed washer 230 to remain in a desired position to provide the desired alignment of the corresponding door 26, 28, 30, or 32, with which the hinge 200 is associated. Further, the detents of the first, second, third, and fourth pluralities of detents, 250, 252, 270, and 272 may each be configured as described above and shown in FIG. 11. As noted above, the detents 250, 252, 270, and 272 may also be provided as dimples, divots, or any other suitable form.

Accordingly, when the hinge 200 is assembled, the rotatable washer 228 and the fixed washer 230 of the adjustable spacer 226 may be abutting and provide surface contact as described above with respect to fixed washer 130 and rotatable washer 128. Further, the rotatable washer 228 may be rotatable around the pivot pin 206 at least between a first position and a second position, and may be limited by rotation stops 294 and 296, as described above with respect to rotatable washer 128 and pivot pin 106.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually, perpendicular, the refrigerator appliance comprising:

a cabinet defining a food storage chamber, the food storage chamber extending between a top portion and a bottom portion along the vertical direction, a first side portion and a second side portion along the lateral direction, and a front portion and a back portion along the transverse direction, the front portion of the food storage chamber defining an opening for receipt of food items;

a door positioned at the front portion of the food storage chamber and movable between a closed position and an open position to permit selective access to the food storage chamber; and a hinge comprising:

a hinge bracket coupled to the cabinet, the hinge bracket comprising a lateral plate;

a pivot pin received in the lateral plate of the hinge bracket, the pivot pin oriented generally perpendicular to the lateral plate of the hinge bracket; the door coupled to the pivot pin such that the door is rotatable with respect to the hinge bracket, a lateral surface of the door spaced apart from the lateral plate of the hinge bracket along the vertical direction by a height; and an adjustable spacer positioned on the pivot pin between the lateral plate of the hinge bracket and the lateral surface of the door and configured to adjust the height, the adjustable spacer comprising a rotatable washer configured for rotating about the pivot pin and a fixed washer abutting the rotatable washer, the fixed washer configured to engage the pivot pin such that the fixed washer is rotationally fixed with respect to the pivot pin, the rotatable washer comprising a first adjustment cam defining a first inclined engagement surface and a second adjustment cam defining a second inclined engagement surface, the fixed washer comprising a third adjustment cam defining a third inclined engagement surface and a fourth adjustment cam defining a fourth inclined engagement surface;

wherein the first inclined engagement surface extends circumferentially around the rotatable washer between a first low point and a first high point, the second inclined engagement surface extends circumferentially around the rotatable washer between a second low point adjacent the first high point and a second high point adjacent the first low point, the third inclined engagement surface extends circumferentially around the fixed washer between a third low point and a third high point, and the fourth inclined engagement surface extends circumferentially around the fixed washer between a fourth low point adjacent the third high point and a fourth high point adjacent the third low point;

wherein the first inclined engagement surface defines a height along the vertical direction, the height of the first inclined engagement surface increases continuously from the first low point to the first high point, the second inclined engagement surface defines a height along the vertical direction, the height of the second inclined engagement surface increases continuously from the second low point to the second high point, the third inclined engagement surface defines a height along the vertical direction, the height of the third inclined engagement surface increases continuously from the third low point to the third high point, and the fourth inclined engagement surface defines a height along the vertical direction, the height of the fourth inclined engagement surface increases continuously from the fourth low point to the fourth high point.

2. The refrigerator appliance of claim 1, wherein the rotatable washer is rotatable around the pivot pin between a first position and a second position, where the third low point abuts the first high point, the third high point abuts the first low point, the fourth low point abuts the second high point, and the fourth high point abuts the second low point in the first position, and the third high point is adjacent to the first high point and the fourth high point is adjacent to the second high point in the second position.

3. The refrigerator appliance of claim 1, wherein the fixed washer and the rotatable washer are positioned such that the first adjustment cam and the second adjustment cam abut the third adjustment cam and the fourth adjustment cam.

4. The refrigerator appliance of claim 1, wherein the rotatable washer further comprises a plurality of engagement means disposed around an exterior perimeter of the rotatable washer.

5. The refrigerator appliance of claim 1, wherein the rotatable washer of the adjustable spacer is positioned proximate to the hinge bracket and the fixed washer of the adjustable spacer is positioned proximate to the lateral surface of the door.

6. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a top portion and a bottom portion along the vertical direction, a first side portion and a second side portion along the lateral direction, and a front portion and a back portion along the transverse direction, the front portion of the food storage chamber defining an opening for receipt of food items;

a door positioned at the front portion of the food storage chamber and movable between a closed position and an open position to permit selective access to the food storage chamber; and a hinge comprising:

a hinge bracket coupled to the cabinet, the hinge bracket comprising a lateral plate;

a pivot pin received in the lateral plate of the hinge bracket, the pivot pin oriented generally perpendicular to the lateral plate of the hinge bracket, the door coupled to the pivot pin such that the door is rotatable with respect to the hinge bracket, a lateral surface of the door spaced apart from the lateral plate of the hinge bracket along the vertical direction by a height; and an adjustable spacer positioned on the pivot pin between the lateral plate of the hinge bracket and the lateral surface of the door and configured to adjust the height, the adjustable spacer comprising a rotatable washer configured for rotating about the pivot pin and a fixed washer abutting the rotatable washer, the fixed washer configured to engage the pivot pin such that the fixed washer is rotationally fixed with respect to the pivot pin, the rotatable washer comprising a first adjustment cam defining a first inclined engagement surface and a second adjustment cam defining a second inclined engagement surface, the fixed washer comprising a third adjustment cam defining a third inclined engagement surface and a fourth adjustment cam defining a fourth inclined engagement surface;

a first plurality of detents formed on the first inclined engagement surface, a second plurality of detents formed on the second inclined engagement surface, a third plurality of detents formed on the third inclined engagement surface, and a fourth plurality of detents formed on the fourth inclined engagement surface.

7. The refrigerator appliance of claim 6, wherein each detent of each plurality of detents includes a retention face and a sliding face oblique to the retention face, the sliding face extending between a root and a crest, the root of the detent defined at an intersection of the sliding face and the inclined engagement surface and the crest of the detent defined at an intersection of the sliding face and the retention face.

8. The refrigerator appliance of claim 6, wherein the first and second plurality of detents are positioned to engage the third and fourth plurality of detents.

* * * * *